US012577732B2

(12) United States Patent
Strimling et al.

(10) Patent No.: US 12,577,732 B2
(45) Date of Patent: Mar. 17, 2026

(54) METHOD OF MAKING FIRE RETARDANT MATERIALS AND RELATED PRODUCTS

(71) Applicant: CLEANFIBER INC., Blasdell, NY (US)

(72) Inventors: Jonathan Strimling, Blasdell, NY (US); Mark Brandstein, Newton, MA (US); Curtis Fischer, Boxford, MA (US)

(73) Assignee: CleanFiber Inc., Blasdell, NY (US)

( * ) Notice: Subject to any disclaimer, the term of this patent is extended or adjusted under 35 U.S.C. 154(b) by 306 days.

(21) Appl. No.: 18/354,588

(22) Filed: Jul. 18, 2023

(65) Prior Publication Data

US 2024/0191430 A1 Jun. 13, 2024

Related U.S. Application Data

(63) Continuation-in-part of application No. 15/733,135, filed as application No. PCT/US2018/063244 on (Continued)

(51) Int. Cl.
*B01J 2/00* (2006.01)
*D21B 1/16* (2006.01)
(Continued)

(52) U.S. Cl.
CPC ..... *D21B 1/16* (2013.01); *D21B 1/32* (2013.01); *D21H 5/0002* (2013.01); *D21B 1/347* (2013.01); *D21C 5/02* (2013.01); *D21H 21/50* (2013.01)

(58) Field of Classification Search
CPC ..... B01J 2/00
See application file for complete search history.

(56) References Cited

U.S. PATENT DOCUMENTS

2002/0170468 A1* 11/2002 Luo ..... C04B 20/1018 106/729
2004/0011483 A1* 1/2004 Hautala ..... D21D 5/02 162/380

(Continued)

FOREIGN PATENT DOCUMENTS

WO WO-2017066728 A1 * 4/2017 ..... E04C 2/16

*Primary Examiner* — Gordon Baldwin
*Assistant Examiner* — Mohammad Mayy
(74) *Attorney, Agent, or Firm* — Caseiro Burke LLC; Chris A. Caseiro

(57) ABSTRACT

Methods for making fire retardant material including fire retardant cellulosic insulation are described. The methods include arrangements for partitioning fibers derived from fiber feedstocks and adding at least a portion of fibers of one or more feedstocks and a fire retardancy chemical compound to a mixer prior to fiber drying. The fibers may be disentangled and/or partitioned prior to mixing with the fire retardancy chemical compound. The fibers may be partially dewatered prior to the drying or other steps of the methods. The feedstock may include old newsprint (ONP), old corrugated containers (OCC), and/or other cellulose-based materials. The method further includes retaining the fibers feedstock and the chemical compound together for enough time to ensure adherence and impregnation of enough of the chemical to and in the fibers after the drying process. Fibers may be partitioned and disentangled prior to, during, and/or after treatment with the fire retardancy compound. The fire retardant cellulose insulation may be a standalone product or may be a component of a finished insulation end product.

37 Claims, 1 Drawing Sheet

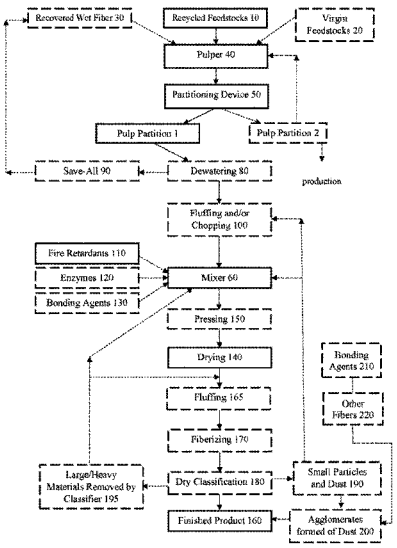

Related U.S. Application Data

Nov. 30, 2018, now abandoned, and a continuation-in-part of application No. 15/768,440, filed as application No. PCT/US2016/057249 on Oct. 15, 2016, now Pat. No. 12,116,776.

(60) Provisional application No. 62/592,994, filed on Nov. 30, 2017, provisional application No. 62/242,645, filed on Oct. 16, 2015.

(51) Int. Cl.

| | |
|---|---|
| ***D21B 1/32*** | (2006.01) |
| ***D21H 21/34*** | (2006.01) |
| *D21B 1/34* | (2006.01) |
| *D21C 5/02* | (2006.01) |
| *D21H 21/50* | (2006.01) |

(56) References Cited

U.S. PATENT DOCUMENTS

| | | | | |
|---|---|---|---|---|
| 2007/0137805 | A1* | 6/2007 | Gerber | A01K 1/0155 162/189 |
| 2016/0168794 | A1* | 6/2016 | Tsujino | D21F 11/00 162/263 |

* cited by examiner

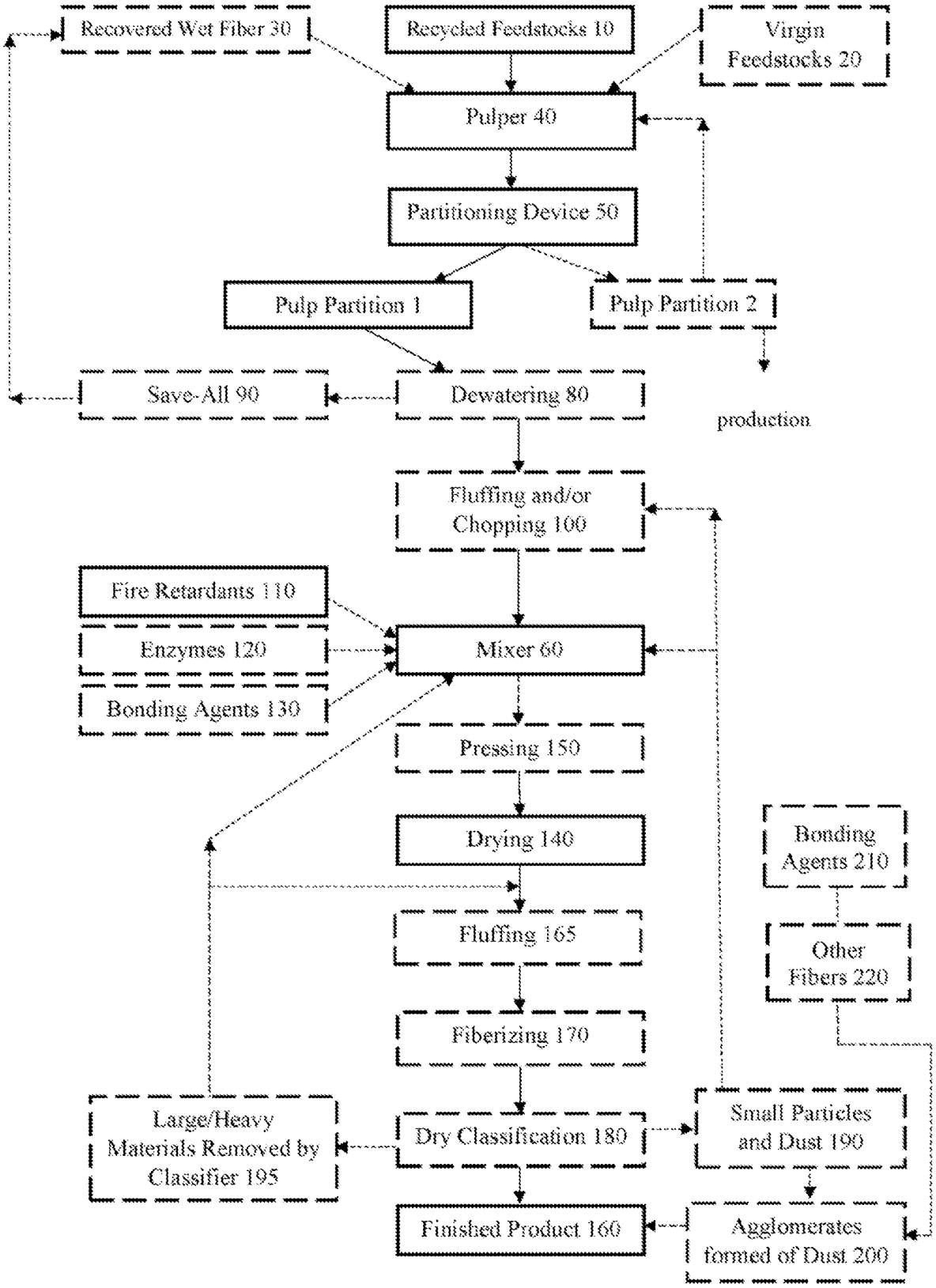
Recovered Wet Fiber 30
Recycled Feedstocks 10
Virgin Feedstocks 20
Pulper 40
Partitioning Device 50
Pulp Partition 1
Pulp Partition 2
Save-All 90
Dewatering 80
production
Fluffing and/or Chopping 100
Fire Retardants 110
Enzymes 120
Bonding Agents 130
Mixer 60
Pressing 150
Drying 140
Bonding Agents 210
Fluffing 165
Other Fibers 220
Fiberizing 170
Large/Heavy Materials Removed by Classifier 195
Dry Classification 180
Small Particles and Dust 190
Finished Product 160
Agglomerates formed of Dust 200

METHOD OF MAKING FIRE RETARDANT MATERIALS AND RELATED PRODUCTS

BACKGROUND OF THE INVENTION

1. Field of the Invention

The present invention relates to making fire retardant materials. More particularly, the present invention relates to making fire retardant insulation. Still more particularly, the present invention relates to insulation made with cellulosic material treated for fire retardancy.

2. Description of the Prior Art

Insulation is widely used for passive thermal control in a broad range of applications, with building insulation being a particularly substantial application. Inorganic fiberglass has been the most common type of material used to make insulation. Fiberglass insulation is provided in blanket and blown fiber form, with the thickness, density, and fiber structure of the blanket or the blown fiber fill determinative of insulative effectiveness, along with the method of installation also impacting effectiveness.

Concerns over the in-situ (installed) effective performance of fiberglass as well as the product's limited fire-retardant characteristics and environmental characteristics, which are regulated under the Federal National Toxicological standards, have raised public and governmental concerns over its continued use as a thermal insulation product. Organic cellulosic insulation has been considered as one type of alternative to fiberglass and can be desirable for that purpose, particularly for its environmental suitability and thermal efficiency. Some cellulosic insulation is made from recycled feedstock, with recycled newsprint being the primary feedstock. Other types of materials, such as cardboard, wood construction debris and the like, have been considered to increase the volume of available feedstock to produce cellulose-based insulation.

Cellulose insulation is made in part using existing paper-making machinery and methods. Specifically, cellulose feedstock in the form of used paper, ordinarily in the form of printed newspaper, is ground, chopped or otherwise mechanically made into small pieces. In order to ensure that the cellulosic insulation conforms to fire retardant standards, the pieces combined with a fire-retardant chemical, which is usually a chemical in powder (i.e., solid) form. The powder must be adhered to the fibers and existing methods of adhering the chemical powder to the fiber, which may include mechanical impingement and/or using an oil to improve adherence have limited effectiveness. Examples of such fire-retardant chemicals include boric acid, borax, ammonium sulfate, monoammonium phosphate, diammonium phosphate, sodium tetraborate, ferrous sulfate, zinc sulfate, magnesium sulfate and mixtures thereof. The treated pieces may then optionally be fiberized, fluffed, or reduced in size to reduce the treated insulation's overall bulk density and improve its suitability for introduction into the structure to be insulated.

The adoption of cellulose insulation as an alternative to fiberglass insulation has been limited for several reasons. First, the cost of fabrication has limited the applications where it is economically competitive. Second, the conventional recycled material used as feedstock is not adequate to produce enough material to meet market demand as a replacement for fiberglass. In addition, the method of converting various types of recycled feedstock can significantly affect the processing cost. Third, the method of joining the fire-retardant material to the cellulose pieces requires the use of a considerable amount of the treatment material. In the case of powdered treatment material, there are challenges in getting the powdered treatment material to adhere to the fibers. There is often an excess of fire retardant material used, which can result in excess dust during installation as well as higher manufacturing costs. When the material is applied at a construction site by installers, a portion of the fire retardants becomes airborne and can become an irritant that can also limit visibility.

Several products and related processes have been described and developed to address the perceived limitations on the manufacture of a viable cellulosic insulation material. U.S. Pat. Nos. 5,534,301 and 6,025,027 to Shutt and U.S. Pat. Nos. 4,386,119 and 4,454,992 to Draganov describe the use of liquid borate to reduce the amount of borate needed to cover cellulose insulation fibers. However, the processes described in those patents involve the application of the liquid borate to dry fibers. This method is of limited commercial value and may not adequately address the difficulty in joining the fire-retardant chemical to the fibers. In addition, using liquid borates can cause embrittlement and breaking of the fibers, which increases the dustiness of the finished product and can adversely impact the product's density and insulation value. More recently, in U.S. Pat. No. 9,045,605, a process is described for reducing the dust associated with the manufacture of a fire-retardant cellulose insulation material in which cellulose material that has been sprayed with liquid fire-retardancy chemicals and dried and then screened so that the end product is less dusty. In the process, individual fibers may be disentangled or partitioned from each other in a dry state, which causes the undesirable fracture of relatively brittle fibers and the formation of excess dust. In addition, fire-retardant chemicals are contained in downstream dust that is removed from the finished product, and so, valuable fiber and flame retardants are lost to the finished product. That process is costly and less effective at generating a cellulose insulation material with satisfactory fire retardancy than exists with the present invention.

Therefore, what is needed is a method for making fire-retardant cellulosic insulation in a cost competitive way. What is also needed is such a method that can be used with new feedstocks instead of, or in addition to, conventional material (including, for example, corrugated cardboard and recycled newsprint). Further, what is needed is a method to improve the fire-retardant chemical application method for fire-retardant chemical retention on and in the cellulosic material and to minimize inclusion of dust in the final product.

SUMMARY OF THE INVENTION

It is an object of the present invention to provide a method for making fire-retardant cellulosic insulation in a cost competitive way. What is also needed is such a method that can be used with new feedstocks instead of, or in addition to, conventional material (including, for example, corrugated cardboard and recycled newsprint). Further, what is needed is a method to improve the fire-retardant chemical application method for fire-retardant chemical retention on and in the cellulosic material and to minimize inclusion of dust in the final product.

These and other objects are achieved with the present invention, which is a method for making fire-retardant cellulosic insulation. The feedstock may be an inorganic material but may also be an organic material, which organic material may be preferable to avoid limitations and possible safety concerns associated with inorganic material. The method is suitable for use in making an insulation product from one or more feedstocks. The one or more feedstocks may include one or more recycled cellulosic feedstock, one or more virgin pulp feedstocks, one or more agricultural fiber sources, and combinations thereof. The amount and type of recycled material and/or virgin material are selectable. Virgin feedstock may be used to make up the amount of pulp required to fill insulation orders dependent upon the availability of recycled material feedstock. Old newsprint (ONP) may be one type of recycled material feedstock. Another suitable type of recycled material feedstock is old corrugated containers (OCC). The invention is not limited to just these two recycled material feedstocks. Additional fiber feedstocks could include sources of agriculturally derived fibers, such as cereal straw, animal feathers, wood byproducts, and other lignocellulosic agricultural byproducts. The invention may include the use of a single feedstock of either type or any other type, provided its characteristics are accounted for in the process of combining it with a fire retardancy chemical. The feedstock is treated for fire retardancy in a mixer that includes a fluid solvent, such as water, but not limited thereto. The ratio of liquid to solids by weight is selectable and may be as low as 20/80 or as high as 99/1.

A system for combining the cellulose feedstock and the chemical treatment includes a chemical treatment source with an input component. The chemical treatment source includes a liquid solution or suspension of treatment material, which may be a combination of a fire retardancy chemical, such as a borate or other suitable compound, at least one solvent such as water, and other optional additives that may be of interest. It is to be understood that an array of suitable fire retardancy chemicals may be employed to treat the cellulosic material. For example, boric acid, borax, ammonium sulfate, monoammonium phosphate, diammonium phosphate, sodium tetraborate, ferrous sulfate, zinc sulfate, magnesium sulfate, and mixtures thereof are suitable. The chemical treatment materials may be dissolved or suspended in the at least one solvent. An aspect of the invention is that the fire retardancy chemical is combined with the feedstock in a liquid form rather than a solid form to provide effective attachment of the fire retardancy chemical to the surface of and into the basic structure of the feedstock component. More specifically, the fire retardant may be allowed to diffuse into external surface of the fibers of the feedstock and/or to diffuse into the core of the fibers.

One or more other additives may be incorporated into the treatment method. For example, a chemical, biological or other additive may be used to eliminate or reduce one or more components of the feedstock that may result in a product with undesirable characteristics. For example, a cellulosic feedstock that is a recycled material may include one or more bonding agents comprising polysaccharides, starches and the like that, if carried through to the end product, may facilitate mold growth. An additive such as an enzyme or other component to break down such undesirable components, and/or make them sufficiently fluidized and/or separated that they can be removed from the treated feedstock, may be added to the blend tank as an aspect of the present invention. A biocide may be added to minimize mold growth.

The chemical treatment source is combined with the plurality of fibers at one or more selectable stages of the cellulose insulation fabrication method prior to final drying of the cellulose material. For example, the input component for the chemical treatment source may be coupled to the blend tank for introduction of the chemical treatment at that point of the method, when the fibers are suspended in a mostly liquid state. However, it is to be understood that the input component for the chemical treatment source may be located elsewhere, including other system component locations provided it is in liquid form when in contact with the cellulose feedstock. Examples of alternative processing steps include the application of a liquid fire retardant in the mixing stage (after partial dewatering) and/or spraying of dried paper with a liquid fire retardant. In addition, dry chemical treatment materials (such as powders) may be subsequently applied to materials that are treated with liquid fire retardants, for specific properties or chemistries that may be advantageously applied in a dry state to a moist surface.

The system of the present invention further includes conventional components including, but not limited to, one or more fiber disentanglement systems (which disentanglement may occur in a slurry state, a partially dewatered state or a dry state), one or more wet partitioning devices (including wet classification devices), dewatering devices, one or more water recovery and return devices, optional fiber dye and/or bleaching devices, one or more dryers, dust collectors, coolers, fluffers, fiberizers, dry classifiers, product collectors and all conduits required to transfer material among the devices of the system. The system may be substantially incorporated into a conventional pulp and fiber manufacturing process of the type typically used in the papermaking industry, for example, rather than as a completely distinct or an extensive add-on to a conventional process. Examples of devices of the system will be described herein, a number of which exist in the conventional pulp/paper processing facilities that currently exist.

The system includes a mechanism for partitioning fibers prior to treatment with a fire retardant and may also optionally include a mechanism for disentangling fibers. Conventional pulping and screening systems from the paper processing industry may be utilized to disentangle and/or partition the fibers. The purpose of disentangling in moist or wet form is to gently break down woven or formed fiber structures (such as paper) to unwind, decouple and free individual fibers. This may occur with the fiber while in a slurry state, where a liquid such as water is used as a medium to convey the fiber. It is noted that the mechanism for disentangling fibers disentangles at least a portion of the contents of a mix of components, including cellulose and non-cellulose fibers. It also disentangles other intended and unintended entanglements, such as clusters, nuggets, and other agglomerations for example, in addition to woven or formed fiber structures.

The system may also include one or more partitioning devices for intentionally dividing the material stream into various component streams with different properties. For example, one partitioning device may intentionally divide heavy components like metals and glass from fiber; another partitioning device may intentionally divide longer fibers from shorter fibers. Partitioning devices that intentionally divide types of fiber from each other will also be referred to herein as classifiers. Cyclonic devices may be used for removing heavy elements from the fiber stream. Fiber screening devices may also or alternatively be utilized to partition fibers by fiber size or geometry. The partitioning system may include means to remove plastics and other products that may float when the fibers are suspended in a slurry with a consistency below about 10%.

The system and related method of the present invention provide an effective and cost competitive way to manufacture a viable cellulose insulation product. The method can be used to make other sorts of products that are fiber-based and that require treatment to establish desired characteristics. The disentanglement of the fibers and the partitioning and/or classification of the fibers in a wet state avoids breakage of fibers, when compared with conventional dry processing. The introduction of the chemical treatment to the pulp prior to fiber drying yields a reduction in chemical treatment costs and overall insulation processing costs. The system and method provide for the option to use only recycled cellulosic material as feedstock or a combination of such feedstock with other materials to ensure an adequate and sustainable supply of feedstock. The system and method also include the introduction of the fire-retardancy chemical treatment prior to a final drying stage of the manufacturing process. This results in a more effective attachment or impregnations of the fire-retardant chemical with the insulation fibers while also reducing the amount of treatment to be used to produce effective fire retardancy.

The present invention enables the manufacture of fire-retardant insulation materials. The feedstock used to make the fire-retardant insulation material may be of any type not limited to specific paper, pulp, container, or other form of material. The invention provides for the combining of a fire retardancy chemical with the feedstock prior to drying of the combination. The fire retardancy chemical is in liquid form when combined with the feedstock. The fire retardancy chemical may be combined with the at least one solvent to be in liquid form before contacting the fibers. The fire retardancy chemical may be in a dry form and combined with the fibers and then introduced to the at least one solvent to be in liquid form. The fire retardancy chemical may be in a dry form and be combined with moist fibers so that it is effectively dissolved by the solvent in the fibers when contacting the fibers. The combination of fire retardancy chemical and the feedstock may be further processed to form a web, a sheet, a plurality of fibers, or other suitable form. The feedstock and fire retardancy combination may be further processed to make insulation, as noted, or other end products wherein fire retardancy is a desirable feature.

The present invention partitions fibers from one another while wet prior to fire retardancy treatment. By partitioning the fibers and optionally at least partially disentangling fibers when wet, there is less breakage of the fibers versus when that partitioning and/or disentanglement occurs while the fibers are dry, which has been the process until the present invention. This reduces dust formation and improves yield. When the fibers are partitioned while wet, there is also less breakage of the fibers as compared to when such partitioning of the fiber stream is carried out while the fibers are dry. This also reduces dust formation.

Fibers that have been disentangled and/or partitioned in a wet state may be mixed in a moist or wet state with fibers obtained from other sources. For example, fibers from various feedstock sources may be mixed together in the wet state or other fibers may be mixed in dry. As another example, recycled paper materials may be mixed with agricultural fibers and/or animal feathers. In addition, dust or smaller fiber fragments recovered from other stages of the production process may be mixed with previously partitioned streams of fibers from earlier stages of processing. The mixture of various fiber sources and long and short fibers can aid in the formation of the desired fiber superstructures that may optionally be created later in this process. Those superstructures may represent the agglomeration of fiber pieces that are otherwise too small to act as effective insulation. The agglomeration of fiber pieces may also be useful to reduce dust in the finished product, to improve the insulation properties of the finished product and/or to favorably impact the density of the finished product.

As part of the present invention, a primary stream of fibers including short fibers and long fibers is intentionally divided into a first stream and a second stream. To facilitate the intentional division of the fibers, the fibers in the stream may be disentangled, such as by being agitated in a slurry of water at low consistency, such as in a pulping operation. Those fiber entanglements may be formed at least partially of cellulose and/or non-cellulose fibers, including "intentional" entanglements, such as from a woven structure, and "unintentional" entanglements, such as naturally occurring agglomerations. For purposes of describing the present invention, "long" fibers are fibers that are longer than a mean fiber length of fibers in the primary stream prior to partitioning while "short" fibers are fibers that are shorter than the mean fiber length of fibers prior to partitioning. What is considered a short fiber and a long fiber may vary in the context of any primary fiber stream and the intended use. With that said, short fibers are typically less than 0.25 centimeters in length. Long fibers are typically longer than 0.1 centimeters in length, which means that fibers in the range of 0.1 cm to 0.25 cm may be short fibers or long fibers, depending on the context of the average fiber length of the streams involved.

As part of this invention, a primary stream including long fibers and short fibers is intentionally divided into (1) a first stream, the "insulation fiber stream" that contains a higher proportion of short fibers and a lower proportion of long fibers than the primary stream, and (2) a second stream, "the non-insulation fiber stream" that contains a lower proportion of short fibers and a higher proportion of long fibers than the primary stream. The second stream, the non-insulation fiber stream, including a majority of long fibers may be desirable for making paper or other products requiring relatively longer fibers. In such applications, short fibers may cause undesirable properties, such as paper that is weaker in tensile strength, and for that reason, it may be desirable to remove short fibers from the non-insulation fiber stream.

The first stream, the insulation fiber stream, may be optionally at least partially dewatered prior to combining that stream with fire retardancy chemicals. In this embodiment of the present invention, a large volume of water can be helpful in the pulping stage for the disentanglement and partitioning of the fibers, but it may be preferable to avoid adding fire retardant chemistry to the larger volume of water. Accordingly, it can be preferable to disentangle and partition fibers first, and then to subsequently dewater, before adding fire retardancy chemicals only to the insulation fiber stream (and not to the non-insulation fiber stream).

For example, the same pulping system can be used to produce both cellulose insulation and linerboard, with a partitioning system used to intentionally divide the two fiber streams. The water from the linerboard system may be recirculated (without fire resistant chemicals) while the fiber stream intended for cellulose insulation may be partially dewatered before the addition of chemicals. This eliminates the risks and complexity of recirculating fire resistant chemistries in larger linerboard operations. These advantages are in addition to those known when combining the fibers and fire retardancy chemicals in liquid form, including less chemical required to achieve a certain level of fire resistance in insulation and less dust generated on the fiber surface. Further, fire retardancy in liquid form is more effective at getting the treatment into the fibers.

The present invention provides a first method for making a fire-retardant insulation for a portion of a fiber set comprising a majority of short fibers while transferring the remainder of the fiber set to another process for making a different product. The method includes the steps of partitioning the primary stream of the fibers into the first stream, introducing the fibers of the first stream to a processing system for making fire-retardant insulation, and into the second stream, and introducing the fibers of the second stream to a processing system for making a product other than the fire-retardant insulation. The method further includes introducing the fibers of the first stream to a mixer, introducing one or more solvents to the mixer, introducing one or more fire-retardant chemicals to the mixer, mixing the fibers, the one or more solvents and the one or more fire-retardant chemicals in the mixer long enough to retain the one or more fire-retardant chemicals on and within the fibers of the first stream to form treated fibers, and drying the treated fibers to form the fire-retardant insulation. It should also be understood that the mixer could be in the form of a conveyor, auger system, or air conveyance system, where one or more solvents and one or more fire retardant chemicals are applied and effectively mixed via the conveyance system.

The first method may also include the option of disentangling, in a moist state, the fibers of the first stream after the step of partitioning the fibers and before the step of drying the treated fibers. The feedstock can include one or more recycled material feedstocks. One or more additives may be added to the mixer before or during the mixing step. The fibers may be disentangled or further partitioned prior to the step of adding the fibers to the mixer. For example, the fibers may be disentangled first to allow the fire retardant to more effectively penetrate clumps of fibers. Alternatively, the fiber stream may be further partitioned to remove contaminants such as sand, glass, or metal, before or after disentangling the fibers. The first method optionally includes the step of partitioning the treated fibers after the step of drying. After drying, the fibers may be partitioned to intentionally divide short fibers from long fibers, to intentionally divide heavy particles like sand, glass, and metal from fiber, and/or to intentionally divide dust from fiber. Fiber residual dust may optionally be recovered from the first stream before introducing the fibers of the first stream to the mixer. Residual fiber dust may also be recovered from the treated fibers after the step of drying. The step of recovering residual fiber dust from the treated fibers may be accomplished utilizing a dry classifier to intentionally divide the residual fiber dust from the treated fibers. Portions of residual fiber dust may be combined together to form treated fiber superstructures. That combining may be accomplished by joining the portions of residual fiber dust together includes combining the portions of residual fibers together with a binder. The treated fiber superstructures may be returned to the mixer as an optional step of the first method. The step of partitioning the fibers may be carried out as part of a pulping process. The one or more feedstocks includes one or more of cereal straw, animal feathers, and other lignocellulosic agricultural byproducts. An insulation product may be made using the described steps of the first method.

The present invention also provides a second method for making a fire-retardant insulation. The second method includes the steps of disentangling fibers of one or more feedstocks while in at least a partially moist state, introducing disentangled fibers of the one or more feedstocks to a mixer, introducing one or more solvents to the mixer, introducing one or more fire-retardant chemicals to the mixer, mixing the fibers, the one or more solvents and the one or more fire-retardant chemicals in the mixer long enough to retain the one or more fire-retardant chemicals on and within the fibers to form treated fibers, and drying the treated fibers to form the fire-retardant insulation. The feedstock can include one or more recycled material feedstocks. One or more additives may be added to the mixer before or during the mixing step. The treated fibers may be classified after the drying step.

The second method may also include the optional step of recovering residual fiber dust from processing the fibers before introducing the fibers to the mixer, and/or the step of recovering residual fiber dust from the treated fibers after the step of drying. The residual fiber dust from the treated fibers may be recovered using a dry classifier or other partitioning device. Portions of residual fiber dust may be adhered to fibers and/or other dust to form treated fiber superstructures. Those portions of residual fiber dust may be combined with a binder. The treated fiber superstructures may be returned to the mixer. Optionally, as part of the second method, the step of disentangling the fibers of the one or more feedstocks may be part of a pulping process. The one or more feedstocks can include one or more of cereal straw, animal feathers, and other lignocellulosic agricultural byproducts. An optional step of the second method includes at least partially dewatering the fibers prior to the step of introducing the fibers to the mixer. An insulation product can be produced using the second method.

For purposes of describing the present invention, "disentangling" fibers means reducing or eliminating direct physical contact between individual fibers and/or individual clumps of fibers. Disentangling as used herein may include teasing clumps of fibers apart into smaller clumps or clumps that are less densely clumped. In addition, disentangling of fiber may ultimately result in the isolation of individual fibers from larger clumps of fibers. Disentangling of fibers may also result in separating fibers from non-fibers. Disentangling may be accomplished when a plurality of fibers are moist or dry. Disentangling may be accomplished via a pulping operation, via fluffing, combing, refining, milling, shredding, or otherwise agitating fibers to reduce clumping.

In addition, for the purposes of describing the present invention, "partitioning" fibers means taking a stream of fibers, which may include a slurry or a partially dewatered stream of fibers (either of which may include individual fibers or clumps of fibers), and intentionally dividing the stream into two or more streams, where the streams have different characteristics. For example, a stream of fibers that contained short and long fibers may be partitioned into two streams, where one stream has a higher proportion of long fibers, and another stream has a higher proportion of shorter fibers. Alternatively, a stream may be partitioned based on particle density, so that a stream containing a mix of fiber with heavy contaminants is partitioned into two streams, one of which may have a larger proportion of heavy contaminants and the other stream may have a smaller proportion of heavy contaminants. The following two examples are not meant to limit the variety of ways in which fibers may be partitioned, and it should be understood that partitioning could be based upon the length of fibers, the weight of particles, the shape of fibers or particles, color, chemistry, the level of clumping/entanglement or a variety of other characteristics. Partitioning of a stream into two or more streams may also be referred to herein as "classifying" fibers. Also note that partitioning (or classifying) may take place in slurry form, in a partially dewatered form, or in a dry state.

A finished insulation product including cellulose may be made solely of the fire-retardant cellulose insulation made by the process described herein. It may also be a component of the finished insulation product wherein one or more other components may be combined with the fire-retardant cellulose insulation to make that finished insulation product. The finished insulation may be manufactured from multiple component streams, such as multiple fiber streams, which may be combined after separate manufacturing steps for a completed form of the finished insulation product. In some cases, it may be advantageous to process one or more of those streams using the methods of this invention, and other streams using other methods such as traditional methods of making insulation including cellulose insulation. It is therefore an embodiment of the present invention to provide a finished insulation product incorporating the steps described herein to make the fire-retardant cellulose insulation that forms a portion of a finished insulation product. As an aspect of the invention, it should be understood that when reference is made to forming a fire retardant insulation, it includes forming a fire retardant cellulose insulation or a component stream that is mixed with other insulation components to form a finished fire retardant insulation product.

BRIEF DESCRIPTION OF THE DRAWING

The FIGURE is a simplified block diagram representation of the method stages and primary system components associated with the manufacture of the cellulose insulation of the present invention. Dashed lines represent optional features, components and steps.

DETAILED DESCRIPTION OF EMBODIMENTS OF THE INVENTION

While the following description is directed to the embodiment of the invention wherein an organic cellulosic insulation is made, it is to be understood that the invention is not limited thereto. Instead, the present invention provides methods to produce cellulose-based insulation having adequate fire retardancy using one or more recycled cellulose-based feedstock material in a cost-effective way. Additionally, the present invention provides for the fabrication of such a product while reducing the inclusion of dust material in the finished product. The steps of the method as described may be done in different orders without deviating from the scope of the invention including, but not limited to, the order in which components are added to a mixer.

Referring generally to the FIGURE, a fire-retardant cellulose insulation of the present invention is created when cellulose-based feedstock material 10 that may include waste material referred to herein as recycled feedstock material, and/or other feedstock materials is/are combined with one or more fire retardancy chemical compounds to produce a fire-retardant cellulose insulation product. The fire-retardant cellulose insulation of the present invention may be a stand-alone insulation product or it may be combined with one or more other components having insulative and/or fire-retardance characteristics to form a multi-component insulation product. The one or more other components may be cellulose-based or they may be non-cellulose based. The one or more feedstock materials are reduced to fiber form prior to or in conjunction with combining with the one or more fire retardancy compounds in a liquid environment. The feedstock material 10, along with optional virgin feedstock 20 and/or recovered wet fibers 30 are transferred to a fiber generating apparatus such as a pulper 40, for example. Other means for generating fibers from the feedstock are known to those skilled in the art, and may also include recovering dry fiber streams from downstream processes.

The pulper 40 may be utilized for disentangling fibers or clumps of fibers from one another. The agitation of fibers in the presence of a liquid such as water can be an effective means of disentangling the fibers to an extent. Pulp generated in the pulper 40 may be transferred to a partitioning device 50 to remove contaminants and/or to classify fibers before introducing the fibers to a mixer 60. The partitioning device 50 may be a wet classification system, such as a screening system that intentionally divides fibers by fiber size. The partitioning device 50 may also be a cyclonic separator that intentionally divides heavy materials from lighter materials. The partitioning device 50 may also have multiple stages and multiple functions, such as combinations of cyclonic separators and screening systems, with the goal of partitioning fibers desired for one use from fibers desired for a different use and/or intentionally dividing out waste materials.

The fibers whether disentangled or partitioned, or any combination thereof, may be transferred to the mixer 60 or a portion, such as those that may be characterized as shorter fibers as defined herein, may be transferred to the mixer 60 while in an embodiment of the invention a remainder of the fibers are diverted to another process for making a product that is not the fire-retardant cellulose insulation, such as the fabrication of linerboard, container board, corrugated medium structures, combinations thereof, or other products, for example. The fibers directed to the mixer 60 for making the fire-retardant cellulose insulation are represented as a first stream of fibers as defined herein, and the remainder to be used for making other product are represented as a second stream of fibers as defined herein. The fibers of the first stream to be treated to become the insulation may be dewatered, at least partially, in dewatering apparatus 80 prior to introduction to the mixer 60, with effluent from the dewatering apparatus 80 optionally transferred to a "save-all" tank 90 for the return of recovered wet fiber 30 to the pulper 40. The at least partially dewatered partitioned fibers or the partitioned fibers that have not been dewatered are transferred directly to the mixer 60 or they may optionally be disentangled by being fluffed and/or chopped in apparatus 100 further disentangling the fibers prior to introduction to the mixer 60. In addition or alternatively, the fibers are agitated directly within the mixer 60 by chopper blades or other mechanical action that may serve as another mechanism to further disentangle the fibers while still at least partially moist or wet. The fundamental function of the chopper 100 is to disentangle the fibers in a wet state so that they are not clumped together but are disentangled into more individual fibers and/or smaller clumps of fibers, which clumps are smaller than clumps existing before reaching the mixer 60. While the fibers may have been originally partitioned and disentangled in an upstream pulping process, the process of at least partially dewatering under pressure can have the effect of re-entangling fibers together, and the chopper 100 can be useful in re-disentangling the fibers from one another. Because the chopper 100 operates on fibers still in the wet state, breakage of the fibers is again minimized. If superstructures of fibers are present while material is being chopped, the chopper 100 may be tuned to maintain the integrity of a specific scale of superstructures, while disentangling other larger clumps, for example. That tuning may be accomplished by selectable spacing between individual chopping blades, for example.

The fibers, whether all fibers or those of the first stream previously described, are mixed in the mixer 60 with one or more fire retardancy chemical compounds 110 and one or more solvents. The one or solvents may be water, another liquid, or a combination of water and another liquid. The solvent may either be added to the mixer 60 or it may come with the partitioned fibers in the transfer from any one of the pulper 40, the partitioning device 50, the dewatering apparatus 80 and the disentanglement apparatus 100. The one or more fire retardancy chemical compounds may be added to the mixer 60 before, during or after introducing the partitioned and optionally disentangled fibers to the mixer 60. Optionally, one or more additives 120 may be added to the mixer 60 before, during or after introducing the fibers to the mixer 60. The one or more additives 120 may be used to enhance the characteristics of the fibers to improve fire retardancy chemical attachment on and in the fibers. For example, the additives may include one or more enzymes suitable to remove residual adhesive from the recycled feedstock material 10. One or more bonding agents 130 may also be added to the mixer 60 before, during or after introducing the partitioned and optionally disentangled fibers to the mixer 60. The one or more bonding agents 130 may be selected to cause individual fibers to clump together and remain joined together. The bonding agents may be added at the mixer 60 or may be applied in downstream processes and may cause the joining to occur in the mixer 60 or at a downstream stage, such as during drying. The bonding between fibers may form fiber superstructures with interstices between the fibers that improve the insulative characteristics of the finished product.

The fibers, the one or more fire retardancy chemical compounds 110, and any optional additives and/or bonding agents contained in the mixer 60 are mixed together for a sufficient amount of time for the fire retardancy chemical compounds to be retained on and in the fibers, and to enable sufficient fiber bonding to occur before completion of processing if it is a goal to form fiber superstructures in the mixer 60. Treated fibers exiting the mixer 60 are transferred to a drying apparatus 140 to be dried to a liquid content in the range of about 5% to about 25% by weight. Optionally, the treated fibers may first be pressed in a pressing apparatus 150. The pressing apparatus 150 may have the function of removing water, helping to form a plurality of superstructures, or both functions. Optionally, the treated and dried fibers may be fiberized in fiberizer 170. The treated and dried fibers may further optionally be classified in dry classifier 180, either directly from the drying apparatus 140 or from the optional fiberizer 170. The purpose of the dry classifier 180 is to ensure that the properties of the finished product meet the targeted characteristics for size, density and/or hydrodynamic diameter. The dry classifier may provide as outputs both the desired product and non-conforming materials, which may include dust (smaller than desired particles) or larger clumps (heavier than desired materials). Following optional classification, a selected subset of treated and dried fibers may then be in satisfactory form to be packaged for use as a a fire-retardant cellulose insulation 160 made as described herein. It is noted that the fire-retardant cellulose insulation 160 may be a standalone insulation product or it may be a component of a composite insulation product containing one or more other components not made in the manner described with respect to the making of the fire-retardant cellulose insulation 160.

When the optional dry classifier 180 is employed, non-conforming materials such as small particles and dust 190, or large and heavy materials 195, may be removed from treated and dried fibers that are the desired product and returned to the mixer 60 or to another stage of the process. Dust may be returned for agglomeration when the one or more bonding agents 130 are in the mixer 60 and/or the small particles and dust 190 may be returned to one or more other apparatuses for reconstitution as fiber superstructure components of the finished end product 160. The small particles and dust 190 may optionally be diverted to an agglomeration apparatus 200, which may simply be a dry mixer, for combining with one or more supplemental bonding agents 210 and/or other supplemental fibers 220 to form additional residual fiber superstructures that may be added to the treated and dried fibers as the end product 160.

The feedstock material 10 may be one or more recyclable materials that are cellulose-based, including, but not limited to any plant-based materials. Additional fiber feedstocks suitable for use in the invention include sources of agriculturally derived fibers, such as cereal straw, animal feathers, and other lignocellulosic agricultural byproducts, for example. The virgin feedstock material 20 may be from a kraft or a groundwood (stone or thermo-mechanical). The ratio of feedstock material 10 to virgin material 20 and/or recovered wet fibers 30 is selectable when the combination is used. The feedstock material(s) may be added to the partitioning device 50 at a level of 1% to 30% solids by weight.

As noted, the virgin feedstock material 20 can be hardwood (1.5 mm), softwood (3.5 mm) (resulting from the kraft process) or groundwood (<1 mm) (includes stone, thermo-mechanical process), and/or cellulose pulp fibers, which may be diverted from a conventional cellulose processing system prior to bleaching, or immediately afterward if that is of interest. Pulp coming off the last black liquor washer in a kraft process, for example, before going into the bleaching process (20% solid by weight) can be used. A pump may be used to move pulped fibers from the pulper 40 to the partitioning device 50. Those of skill in the art will recognize that any sort of material transfer mechanism may be used to move material including, but not limited to, pulped material from one location to another for the process of the present invention.

Recycled newsprint pulp may be obtained from a conventional paper recycle process, such as from ONP #8 and #9 sources, for example. The paper can be introduced into the pulper 40. The pulper 40 is a tank that has an agitator and a source of solvent, such as water, to pulp the feedstock. The agitation disentangles the fibers and breaks down the cellulosic material into fiber stalks. The one or more fire retardants 110 may be delivered to the mixer 60 in liquid form, such as by being dissolved in a solvent such as water. The fire retardants 110 when combined with fibers in a liquid environment are better adhered to the surface of and absorbed into the structure of the fibers than when dry fire retardancy chemicals are applied to the exterior of dry fibers. The addition of fire retardants to wet fibers in a mixer can also provide better absorption and better uniformity of distribution as compared to when liquid fire retardancy chemicals are simply sprayed onto dry feedstock such as paper rather than fibers in a moist state, particularly fibers that may have been disentangled prior to or during the mixing operation. The fire retardant can be in a dry or a wet form combined with fiber in wet form or it can be combined in dry or wet form with fibers and the one or more solvents. The one or more fire retardants may be selected from boric acid, borax, ammonium sulfate, monoammonium phosphate, diammonium phosphate, sodium tetraborate, ferrous sulfate, magnesium sulfate, zinc sulfate and mixtures thereof. An example of a suitable fire retardancy chemical composition is described in U.S. Pat. No. 8,043,384, the content of which is incorporated herein by reference.

The chemical saturation, operating temperature, and dwell time in the mixer 60 is selectable to ensure that the finished cellulose insulation contains a sufficient amount of fire-retardancy material adhered in and to the fibers of the insulation. The one or more retardants dissolved in solvent can range from 1% to 50% solids content. The contents of mixer 60 can be combined at in a temperature range from 25 C to 80 C. The mixer may actively agitate the contents of mixer 60 for a period ranging from 5 sec to 30 minutes, after which, the material may be allowed to dwell and homogenize in the mixer or a subsequent storage or conveyance system for a period of 5 minutes to 48 hours. The one or more other additives may be used to hydrolyze starch, polysaccharide, or other undesirable materials, for example, as well as one or more biocides, as desired to minimize mold growth in the end product 160. The chemicals, additives and/or bonding agents may be mixed together before transfer to the mixer 60 such as with a mixing valve, or they may be transferred separately to the mixer 60.

The optional dewatering apparatus 80 is selected from any number of existing systems that take a cellulose pulp slurry and remove water to a desired solids content. Any type of screw press, twin wire press, vacuum filter, plate and frame press, roll press, or centrifugal drum, for example, can be used as the dewatering apparatus 80. The optional dewatering system 80 may increase the solids content of the slurry containing the treated fibers to about 30% or more but not limited thereto.

A pump or other form of material transfer mechanism can be used to transfer dewater effluent to the save-all 90, which separates fibers from fluid. This can be accomplished by a flotation, rotary (vacuum filters) or wire (fabric) system that can efficiently remove the fluid. The fibers from the save-all are moved to the recovered wet fiber container 30. Excess fluid from the save-all 90 can be filtered for use in other process components of the system or put into a waste treatment process for removal.

The optional fluffer/chopper 100 is configured to break up a pulp cake of treated fibers or optionally at least partially dewatered treated fibers. The fluffer/chopper 100 can be two counter rotating meshed blades with a discharge to the drying system 140. Any number of fluffers can be used to break up the pulp cake. The pulp cake can be broken up ahead of the mixer 60 or internally within the mixer 60 by blades internal to the mixer that may be designed to disentangle fibers.

The drying system 140 is used to dry the treated fibers down to a desired moisture content, which may range from 8-25% in moisture content (75-92% solids), for example, but not limited thereto. A dryer, such as but not limited to, a rotary drum dryer or flash dryer system that breaks up and fluffs the pulp while drying may be advantageous, but other drying systems such as microwave dryers and conveyorized dryers may also be employed. A belt conveyor, auger system or other form of conveyance device may be used to transport the dried and chemically treated fibers to a location for cooling. An exhaust gas/hot air collection system from the dryer system may be employed to take moist air and recirculate it back through the drying system 140 to capture residual heat before exhausting to the atmosphere.

An optional dry fluffer 165 may be used to disentangle clumps of materials that may have formed in the drying process, while minimally affecting the basic structure of the fibers and while retaining desired fiber superstructures when such superstructures form part of the end product. Alternatively, an optional fiberizer 170 may be used as a more aggressive measure to further refine the treated and dried fibers, by further disentangling fiber clusters, reducing the size of the fibers clusters, individuating fibers, and fibrillating fibers after the drying process. Those partially disentangled or fully disentangled fibers and/or fiber superstructures may optionally be further partitioned by size using the dry classifier 180. The dry fluffer 165 and the fiberizer 170 can be mechanical devices with rotating toothed plates in close proximity to one or more sets of static or counter rotating toothed plates such that when clumps of fibers are conveyed through the device 165/170, they are subjected to shear forces which can disentangle clumps of fibers and may also individuate fibers and fibrillate fibers. The distinction between a fluffer and a fiberizer is in the severity of their interaction with the materials, with a fluffer more gently disentangling groups or clumps of fibers and a fiberizer more aggressively impacting the materials with greater shear.

A hammer mill is an example of a fiberizer, but there are also fiberizers formed with one or more rotating toothed plates in close proximity to one or more stationary or counterrotating toothed plates. Traditional fiberizers used to make cellulose insulation with dry fire retardants mix the chemical and fiber in a high velocity grinding motion, which can have the effect of pressing chemicals onto the fibers and creating adhesion. While this process can be used to meet regulatory requirements, the dust can come off during installation, creating a dusty work environment and impeding visibility. The method of the present invention takes the treated fibers with the absorbed chemicals and dries them as individual fibers or clumped together into desired superstructures. Because the fire retardant is inside the fibers, the present invention dramatically reduces the amount of chemical dust produced during installation.

The optional chopper 100 may be used instead of the optional fiberizer 170 but it is used prior to drying the treated fibers. In that way, dust formation is reduced as compared to when the fiberizer 170 is used after drying. The use of the chopper 100 breaks up the clumps in a way that is different from the fiberizing and post-drying disentanglement processes described above. Specifically, because the fibers are moist, they are more pliable and less susceptible to breakage. Further, fibers may be combined with one or more binders to form superstructures before chopping. The binder may be a chemical additive suitable for joining fibers together, and a suitable binder may be a starch, adhesive, or other binder. These superstructures may have spaced bonds between fibers and/or fiber particulates that establish voids for improving insulative and density characteristics and those bonds may be formed directly or through use of an optional binder. The use of the chopper 100 instead of the fiberizer 170 can improve the likelihood of maintaining superstructure integrity because the fibers are more pliable and less fragile in a moist or wet state.

Treated and dried fibers may optionally be sent for testing. Testing may be performed on the fibrous material that is the cellulose insulation of the present invention for compliance with all regulations concerning blown-in cellulosic fiber insulation as directed by the C-739, HH I515, and the Consumer Product Safety Council. The treated fibers made using the method of the present invention can be used as a fire retardant, thermal, sound and radiant barrier material for insulating.

In addition to being used to partition fibers with differing characteristics, the partitioning device 50 can also intentionally divide streams of contaminants from streams containing the desired fibers from the feedstocks. These contaminants of the recycled feedstock material 10 may include glass, plastic or other non-cellulose elements, for example. The partitioning device 50 may be comprised of a screening system, or a cyclonic separator, which are two examples of partitioning technologies that may be applicable. The partitioning device 50 may additionally include or instead be a screening apparatus such as the type shown at: https://www.andritz.com/products-en/group/pulp-and-paper/pulp-production/kraft-pulp/pulp-drying-finishing/pulp-screening-cleaning, for example, to facilitate fiber classification prior to introducing the feedstock material into the mixer 60.

The optional dry classifier 180 may be used to partition by size treated and dried fibers so that relatively small particulates that are effectively dust particles are removed from the product to minimize dust inclusion in the finished product. The dry classifier 180 may be a screening apparatus or an air classifier. An air classifier may use an upward airflow to partition lighter elements from heavier elements, for example. The dry classifier 180 may operate to partition fibers based on size, density, hydrodynamic diameter or other characteristics. For example, the dry classifier 180 may be utilized to select fibers, which may be critical in producing high performing product, and to reject less desirable fractions of the processed materials, such as heavy contaminants like sand, glass, and metal, which would otherwise degrade the properties of the finished product. Alternatively, a dry classifier 180 may also be utilized to reject lighter fractions of a stream such as dust, so that dust is rejected and excluded from the finished product, while fibers are accepted and conveyed forward to the finished product.

Examples of the product of the present invention were made using the method of the present invention as described herein. Fibers were disentangled via a pulping process and then partitioned using a classification system, subsequently being treated with fire resistant chemicals, mixed with other fiber sources and dried to produce finished product. The finished product was tested against ASTM C739 and found to be fully compliant. The product was provided to installers in the field and found to be a high quality finished product that was low in dust.

The present invention of methods for providing an improved fire-retardant material and, in particular, a cellulose insulation fabrication and the cellulose insulation made thereby, have been described with respect to specific components and method steps. Nevertheless, it is to be understood that various modifications may be made without departing from the spirit and scope of the invention. All equivalents are deemed to fall within the scope of this description of the invention as identified by the following claims.

What is claimed is:

1. A method for making a fire-retardant cellulose insulation comprising the steps of:

partitioning a primary stream of fibers that contains short and long fibers into a first stream and a second stream, wherein the fraction of the fibers of the first stream that are short fibers is higher than the fraction of short fibers in the primary stream and the fraction of the fibers in the seconds stream that are long fibers is higher than the fraction of long fibers in the primary stream;

introducing the fibers of the second stream to a processing system for making a product other than the fire-retardant insulation, partially dewatering fibers of the first stream;

introducing the fibers of the first stream to a mixer;

introducing one or more solvents to the mixer;

introducing one or more fire-retardant chemicals to the mixer;

mixing the fibers, the one or more solvents and the one or more fire-retardant chemicals in the mixer long enough to retain the one or more fire-retardant chemicals on and within the fibers of the first stream to form treated fibers; and drying the treated fibers to form the fire-retardant cellulose insulation.

2. The method of claim 1 further comprising the step of combining the fire-retardant cellulose insulation with one or more other components to make a finished insulation product.

3. The method of claim 1 further comprising the step of disentangling, in a moist state, the fibers of the first stream after the step of partitioning the fibers and before completing the drying of the treated fibers.

4. The method of claim 1 wherein the feedstock includes one or more recycled material feedstocks.

5. The method of claim 1 further comprising the step of adding one or more additives to the mixer before or during the mixing step.

6. The method of claim 1 further comprising the step of disentangling, in a moist state, the fibers of the first stream after the step of partitioning the fibers, and then subsequently partitioning the fibers again before the drying of the treated fibers is completed.

7. The method of claim 1 further comprising the step of disentangling, in a moist state, the fibers of the first stream after the step of partitioning the fibers, and then subsequently disentangling the fibers again before the drying of the treated fibers is completed.

8. The method of claim 1 further comprising the step of disentangling the treated fibers after the step of drying.

9. The method of claim 1 further comprising the step of classifying the treated fibers after the step of drying.

10. The method of claim 1 further comprising the step of recovering dust generated in the production process by adding recovered dust to the mixer.

11. The method of claim 1 further comprising the step of recovering residual fiber dust from the treated fibers after the step of drying.

12. The method of claim 11 wherein the step of recovering residual fiber dust from the treated fibers utilizes a dry classifier to partition the residual fiber dust from the treated fibers.

13. The method of claim 12 further comprising the step of combining portions of residual fiber dust together with fibers to form treated fiber superstructures.

14. The method of claim 13 wherein the step of combining portions of residual fiber dust together includes combining the portions of residual fibers and dust together with a binder.

15. The method of claim 13 further comprising the step of returning the treated fiber superstructures to the mixer.

16. The method of claim 1 wherein the step of partitioning the fibers of the one or more feedstocks includes partitioning the fibers using a screening system while the fibers are in a slurry with a consistency below 10%.

17. The method of claim 1 wherein the step of partitioning the fibers of the one or more feedstocks includes partitioning the fibers using a cyclonic separation system while the fibers are in a slurry with a consistency below 10%.

18. The method of claim 1 wherein the step of partitioning the fibers of the one or more feedstocks includes partitioning the fibers after a pulping process is used to disentangle the fibers.

19. The method of claim 1 wherein the one or more feedstocks includes one or more of cereal straw, animal feathers, and other lignocellulosic agricultural byproducts.

20. A method for making a fire-retardant cellulose insulation comprising the steps of:

disentangling fibers of one or more feedstocks while in at least a partially moist state;

introducing fibers of the one or more feedstocks to a mixer;

introducing one or more solvents to the mixer;

introducing one or more fire-retardant chemicals to the mixer;

mixing the fibers, the one or more solvents and the one or more fire-retardant chemicals in the mixer long enough to retain the one or more fire-retardant chemicals on and within the fibers to form treated fibers;

drying the treated fibers to form the fire-retardant cellulose insulation; and partitioning the fibers after disentanglement of the fibers and prior to when the treated fibers are fully dried.

21. The method of claim 20 further comprising the step of combining the fire-retardant cellulose insulation with one or more other components to make a finished insulation product.

22. The method of claim 20, wherein at least a portion of the disentanglement of the fibers takes place prior to the mixing process.

23. The method of claim 20 wherein at least a portion of the disentanglement of the fibers takes place within the mixer.

24. The method of claim 20 wherein at least a portion of the disentanglement of the fibers takes place during the drying process and before the material is fully dried.

25. The method of claim 20 wherein the feedstock includes one or more recycled material feedstocks.

26. The method of claim 20 further comprising the step of adding one or more additives to the mixer before or during the mixing step.

27. The method of claim 20 further comprising the step of partitioning the treated fibers after the step of drying.

28. The method of claim 20 further comprising the step of recovering residual fiber dust from the processing of fibers by adding the dust to the mixer.

29. The method of claim 20 further comprising the step of recovering residual fiber dust from the treated fibers after the step of drying.

30. The method of claim 29 wherein the step of recovering residual fiber dust from the treated fibers comprises directing the treated fibers to a dry classifier.

31. The method of claim 29 further comprising the step of combining portions of residual fiber dust together with dust to form treated fiber superstructures.

32. The method of claim 31 wherein the step of combining portions of residual fiber dust together includes combining the residual fiber dust with a binder.

33. The method of claim 31 further comprising the step of returning the treated fiber superstructures to the mixer.

34. The method of claim 20, wherein the step of partitioning the fibers includes screening the fibers while in a slurry state with a consistency below 10%.

35. The method of claim 20, wherein the step of partitioning the fibers comprises using cyclonic separation of streams of the fibers while in a slurry state with a consistency below 10%.

36. The method of claim 20 wherein the one or more feedstocks includes one or more of cereal straw, animal feathers, and other lignocellulosic agricultural byproducts.

37. The method of claim 20 further comprising the step of at least partially dewatering the fibers prior to the step of introducing the fibers to the mixer.

* * * * *